US008257131B2

(12) United States Patent
Truckai

(10) Patent No.: US 8,257,131 B2
(45) Date of Patent: Sep. 4, 2012

(54) MODULAR TOY AND WRITING INSTRUMENT

(75) Inventor: Csaba Truckai, Saratoga, CA (US)

(73) Assignee: Hermes Innovations, LLC, Cupertino, CA (US)

( * ) Notice: Subject to any disclaimer, the term of this patent is extended or adjusted under 35 U.S.C. 154(b) by 0 days.

(21) Appl. No.: 12/829,681

(22) Filed: Jul. 2, 2010

(65) Prior Publication Data

US 2011/0130067 A1 Jun. 2, 2011

Related U.S. Application Data

(63) Continuation of application No. 11/582,421, filed on Oct. 18, 2006, now Pat. No. 7,780,499.

(51) Int. Cl.
*A63H 33/06* (2006.01)
*A63H 33/00* (2006.01)

(52) U.S. Cl. ..... 446/73; 446/76; 446/97; 401/195

(58) Field of Classification Search ..... 446/71, 446/73, 75, 76, 85, 92, 117, 119–126; 401/57, 401/195

See application file for complete search history.

(56) References Cited

U.S. PATENT DOCUMENTS

| | | | | |
|---|---|---|---|---|
| 3,611,609 | A | 10/1971 | Reijnhard | |
| 3,708,235 | A | 1/1973 | Kolomeir | |
| 4,012,155 | A | 3/1977 | Morris | |
| 4,509,929 | A | 4/1985 | Zawitz | |
| 4,519,788 | A | 5/1985 | Ajiro et al. | |
| 4,758,196 | A | 7/1988 | Wang | |
| 4,813,903 | A * | 3/1989 | Furukawa et al. | 446/90 |
| 4,823,532 | A | 4/1989 | Westerburgen | |
| 4,983,062 | A | 1/1991 | Hour | |
| 5,322,466 | A | 6/1994 | Bolli et al. | |
| 5,839,938 | A | 11/1998 | Manthei et al. | |
| 5,919,072 | A | 7/1999 | Pohlman | |
| 5,964,635 | A | 10/1999 | Krog | |
| 6,086,445 | A | 7/2000 | Zawitz | |
| 6,149,330 | A | 11/2000 | Chuang | |
| 6,254,298 | B1 | 7/2001 | Hsu | |
| 6,702,641 | B2 | 3/2004 | Oakley | |
| 6,736,691 | B1 | 5/2004 | Bach | |
| 6,887,120 | B2 | 5/2005 | Shamitoff | |
| 6,948,998 | B2 | 9/2005 | Bagley | |
| 2006/0179778 | A1 | 8/2006 | Kowalski | |
| 2007/0041780 | A1 | 2/2007 | Hsu | |

OTHER PUBLICATIONS

PCT Patent Application No. PCT/US2010/046224 filed Aug. 20, 2010 in the name of Truckai, Search Report and Written Opinion dated Oct. 20, 2010.

U.S. Appl. No. 11/582,421, filed Oct. 18, 2006 in the name of Truckai, Non-final Office Action mailed Feb. 23, 2009.

U.S. Appl. No. 11/582,421, filed Oct. 18, 2006 in the name of Truckai, Final Office Action mailed Dec. 9, 2009.

U.S. Appl. No. 11/582,421, filed Oct. 18, 2006 in the name of Truckai, Notice of Allowance mailed Apr. 29, 2010.

* cited by examiner

*Primary Examiner* — Kien Nguyen
(74) *Attorney, Agent, or Firm* — Levine Bagade Han LLP

(57) ABSTRACT

A modular combination toy and desktop writing accessory apparatus comprising a plurality of structural elements each having at least one nodal connector portion to which a complementary connector portion of another structural, element can be coupled. The structural elements can be assembled into a barrel-like form that is configured with a passageway for carrying a writing component of the invention. The writing component can be a pen, pencil, marker, crayon, eraser or the like. The modular combination toy and writing instrument has multiple functions in playtime as well as in everyday desk-bound activities.

27 Claims, 11 Drawing Sheets

MODULAR TOY AND WRITING INSTRUMENT

CROSS-REFERENCE TO RELATED APPLICATIONS

This application is a continuation of U.S. patent application Ser. No. 11/582,421, filed on Oct. 18, 2006, the content of which is incorporated herein by reference in its entirety.

BACKGROUND OF THE INVENTION

1. Field of the Invention

The invention relates generally to a toy with modular parts, and in particular relates to a combination toy and writing accessory that has multiple functions in playtime as well as in everyday desk-bound activities.

2. Description of the Prior Art

The assembly of toy structural members or building blocks into models and predetermined assemblies that represent figures, machines, vehicles and the like is a universally practiced activity among children across a wide range of ages. Such 'building block' systems and models are well known and include systems commercialized over the years by Meccano™, Erector Set, Lego™, Märklin™ and System Xox™ among others. The use of such building block toys and model systems can greatly contribute to a child's development relating to mechanical and engineering conceptualization and problem-solving. However, the typical use of such building block toy systems requires a 'dedicated' playtime using the 'dedicated' building blocks. It is believed that time demands on children, in particular time spent in the classroom, has contributed to a decline in interest in many forms of building block toy systems. Thus, it is desirable to provide a combination 'toy' and 'writing instrument' based on a building block system that permits the child to spend his or her desk-bound time in mechanical and engineering conceptualization activities and it is to this end that the present invention is directed.

SUMMARY OF THE INVENTION

The combination toy and writing instrument of the invention allows children to imagine and assembly toys and structures, including but not limited to spacecraft, aircraft, landcraft, watercraft, submarines, buildings, castles, wearable ornaments and the like, that can define a new playscape while confined to a desk. The invention provides building elements that allow for complete freedom in the assembly of three-dimensional constructions while at the same time being inexpensive, safe and fun.

Thus, a modular combination toy and desktop writing accessory is provided. The combination apparatus includes a plurality of structural elements each having at least one nodal connector portion to which a complementary connector portion of another structural element can be coupled. The structural elements can be assembled into a barrel-like form that is configured with a passageway for carrying a writing apparatus that is a further component of the invention. The combination toy and writing accessory thus comprises: a writing cartridge and a plurality of structural elements connectable to one another in a surrounding arrangement relative to the writing cartridge wherein the structural elements are connectable to one another in a plurality of non-surrounding arrangements in the absence of the writing cartridge to form a toy.

The writing cartridge is selected from the group consisting of pens, pencils, markers and crayons and the like.

DETAILED DESCRIPTION OF THE INVENTION

The invention is particularly applicable to a toy and writing accessory that includes a plurality of structural elements or members that each are configured with complementary connector features as described below. The connector features allows the structural elements to be assembled in a writing-functional configuration when the toy is used as a writing instrument. Additionally, a plurality of the structural elements can be re-assembled in a multitude of non-writing configurations to form a 3-dimensional toy, figure, building etc. as described below. In this context, it will be appreciated that a modular assembly in accordance with the invention can have a range in utility from being a dedicated writing instrument to a being a "toy" with features for various play applications. Further, the modular assembly can be a combination functional writing instrument and a toy assembly, all of which assemblies are within the scope of the invention.

Figure 1:
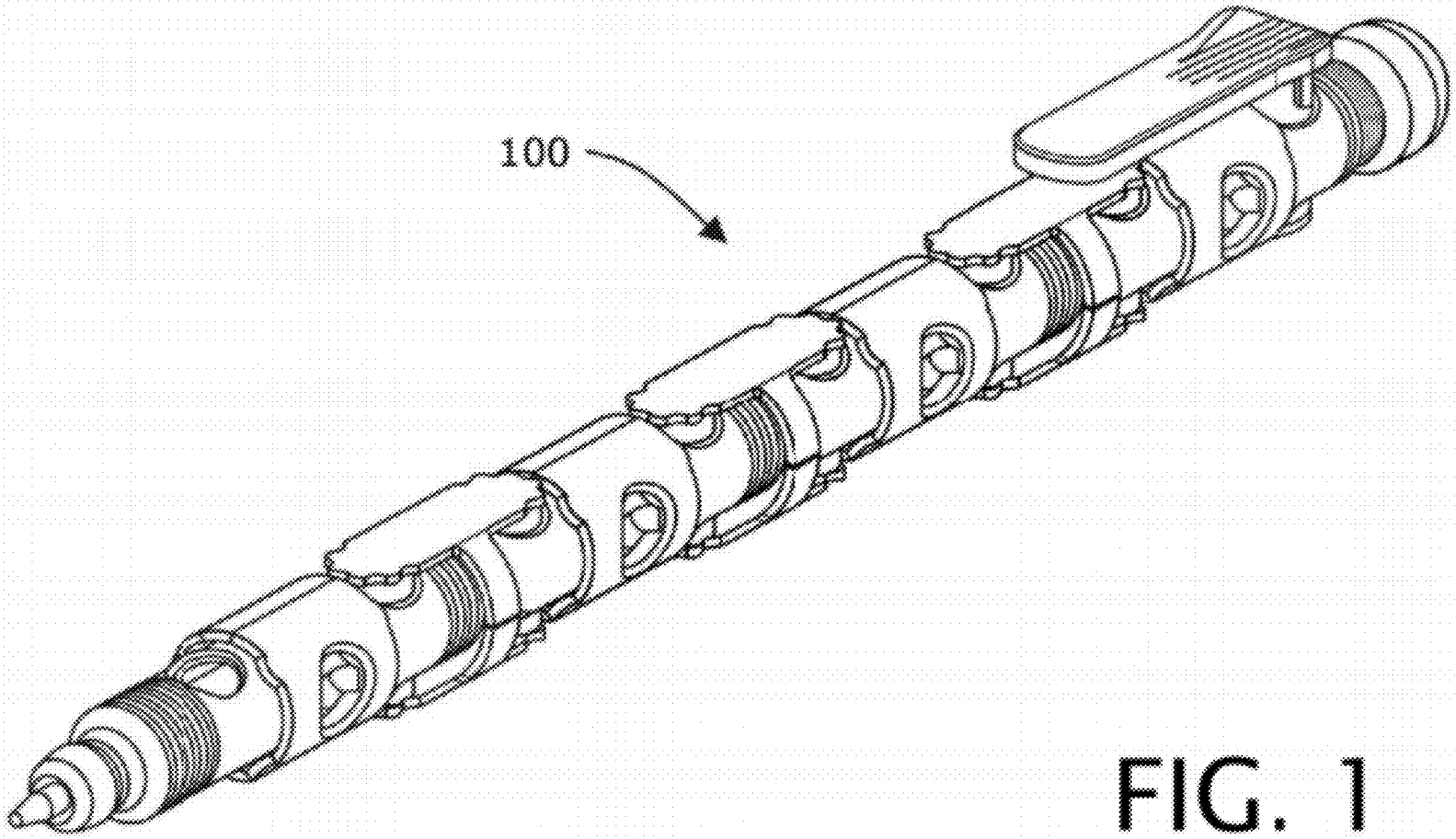
FIG. 1 is an illustration of an embodiment of a modular combination toy and writing accessory in accordance with the invention.

FIG. 1 is an illustration of one embodiment of a combination modular toy and writing accessory 100 in accordance with the invention. The modular toy or pen apparatus as depicted in the exploded view of FIG. 2 reveals that the pen of FIG. 1 comprises an assembled set of exemplary snap-fit structural elements 110, 112 and 114 that further includes a writing element or cartridge indicated at 115. By the term 'snap-fit', it is meant that the fit of any complementary connector features can be an interference fit, a friction fit, a sliding fit or a fit wherein a connector component is slightly deformable for flexible snapping into place with a cooperating structural feature. The writing element 115 in this embodiment comprises a ball-point pen but the writing element can consist of any ink marker, graphite marker, crayon marker, eraser or the like.

Figure 2:
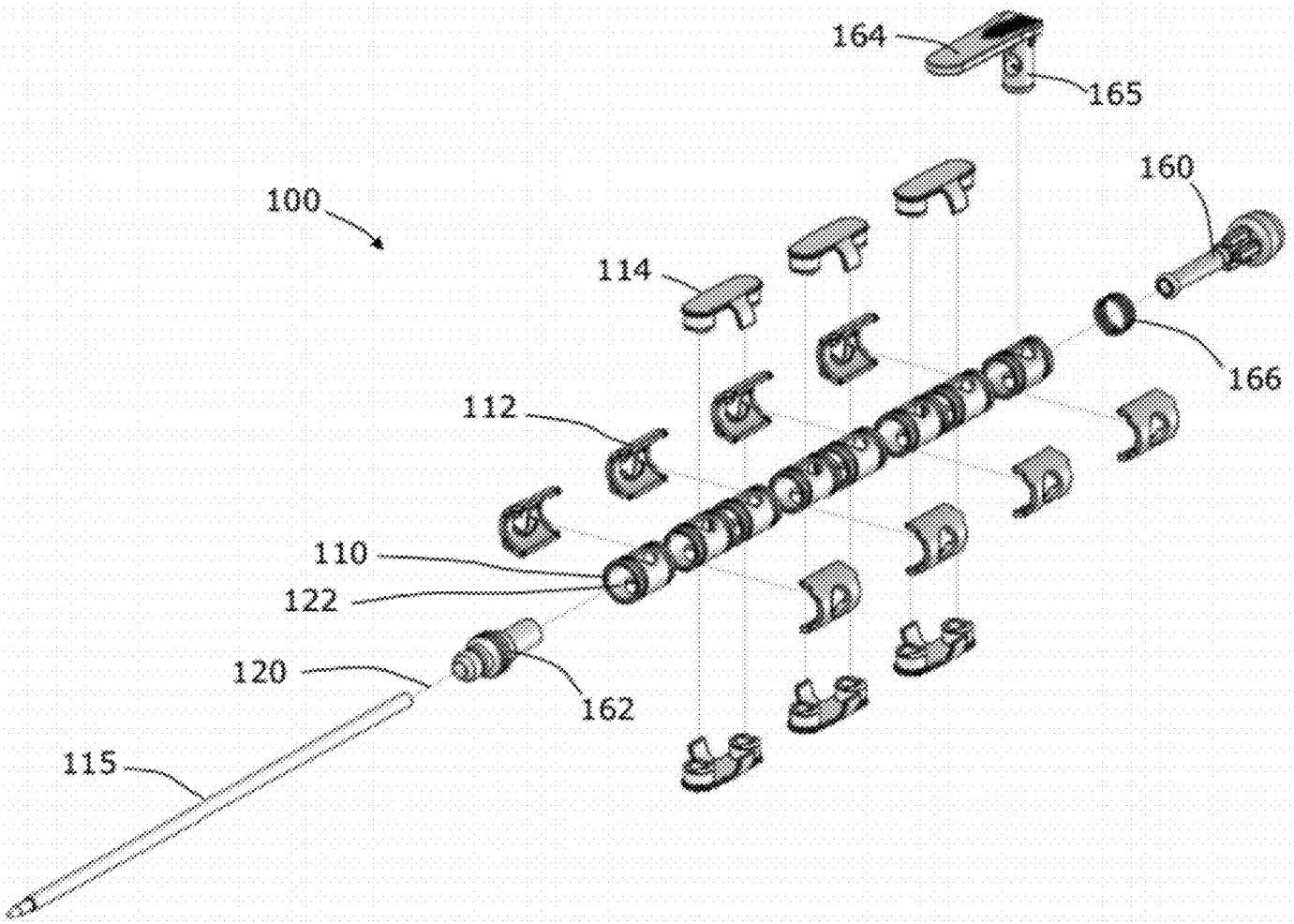
FIG. 2 is an exploded diagram view of the modular combination toy and writing accessory of FIG. 1 showing the exemplary structural elements with complementary connector features in accordance with the invention.
Figure 3:
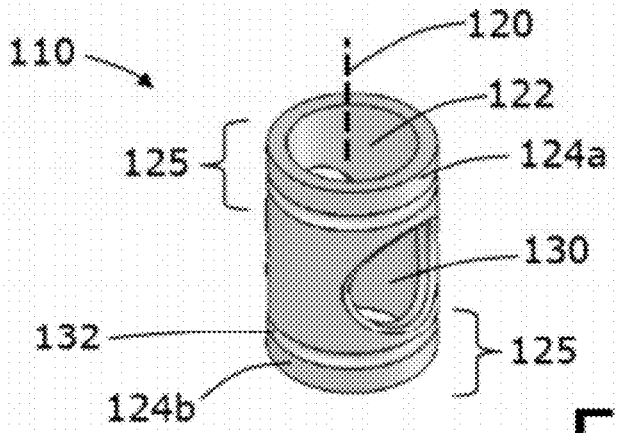
FIG. 3 is a perspective view of a first exemplary structural element of the invention.

In the exploded view of FIG. 2, it can be seen that structural element 110 comprises a barrel-like body extending about longitudinal axis 120 with body walls surrounding passageway 122 within the element. An enlarged view structural element 110 is provided in FIG. 3. As can be seen in FIG. 3, structural element 110 includes body ends 124*a* and 124*b* that comprise a "projecting" connector feature indicated at 125 that is adapted to be engaged by a "receiving" connector feature of structural element 112 when assembled (see FIGS. 2 and 4). The structural element 110 further includes at least one "receiving" connector feature 130 on a side of the element for receiving a "projecting" connector feature of another structural element. The body ends 124*a* and 124*b* of structural element 110 further include a groove 132 for cooperating with a complementary feature of element 112 described below. In general, the structural elements typically have an extending medial strut portion extending between first and second ends. Further, the elements include one or more "nodal" connector features on at least one end or medial portion of such a structural element. By the term 'nodal', it is meant that the connection between structural elements comprises a node wherein the axes of the elements can be oriented at different relative angles and/or rotational angles about the connection.

Figure 4:
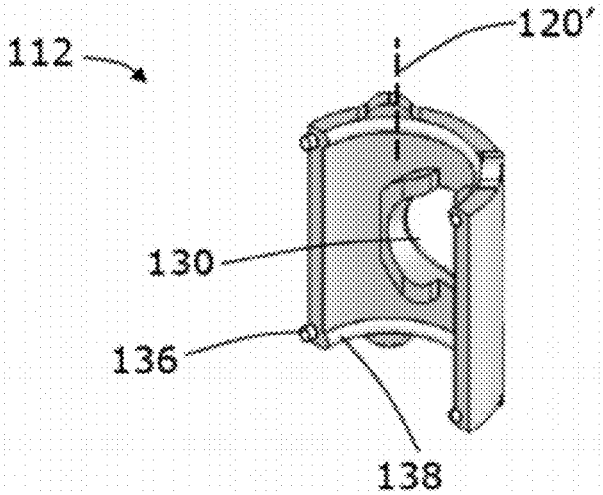
FIG. 4 is a perspective view of a second exemplary structural element of the invention.

Now referring to the exploded view of FIG. 2 and FIG. 4, structural element 112 comprises another "one-half" barrel body extending about longitudinal axis 120' that can be connected with another similar structural element to form a "receiving" feature to snap-fit to form a barrel-like shape and thereby grip and receive an end of structural element 110. The snap-fit assembly of first and second elements 112 is enabled by male and female snap-fit features indicated at 136. Structural element 112 carries a circumferential rib 138 that cooperates with groove 132 in structural element 110. Further, structural element 112 includes a "receiving" connector feature 130 for receiving a "projecting" connector feature 145 such as in structural element 114.

Figure 5:
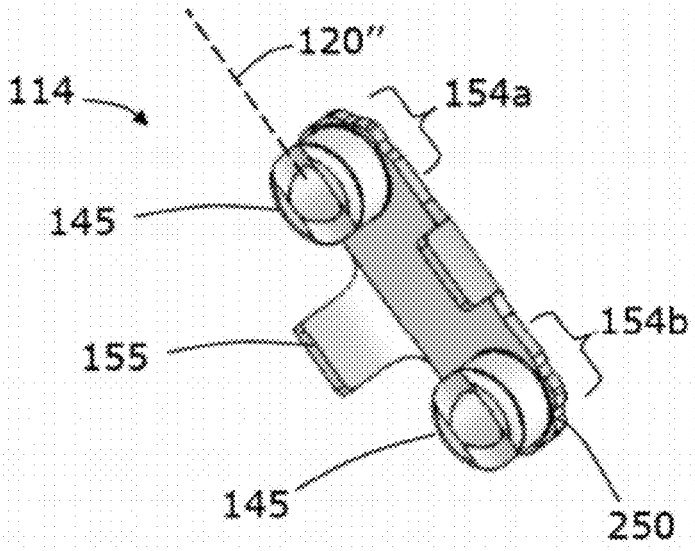
FIG. 5 is a perspective view of a third exemplary structural element of the invention.

Referring now to FIGS. 2 and 5, structural element 114 comprises another body extending relative to axis 120" and having first and second body end portions 148*a* and 148*b* that have snap-fit projecting features 145 that project from the body perpendicular to axis 120". The projecting features 145 are dimensioned to snap-fit into receiving features 130 of structural elements 110 and 112. As can be seen in FIGS. 1 and 2, these structure elements can be connected in multiple arrangements to provide the elongated barrel of a writing instrument. The views of FIGS. 1, 2 and 4 illustrate that structural element 114 further includes part-circumferential body wings 155 that are dimensioned to engage the outer surface of another structural element when connected in a longitudinal orientation, that is with the axes 120, 120' and 120" all in alignment.

In one embodiment as shown in FIGS. 1 and 2, the apparatus further includes a connectable proximal pen body 160 and distal pen body 162 that each can be snap-fit to ends of an assembled pen barrel to thereby capture writing element 115 therein (e.g., a ball-point ink cartridge). A snap-fit pocket clip 164 with a single projecting feature 165 also is shown in FIGS. 1 and 2 to make the toy assembly into a fully functional writing instrument.

Figure 6:
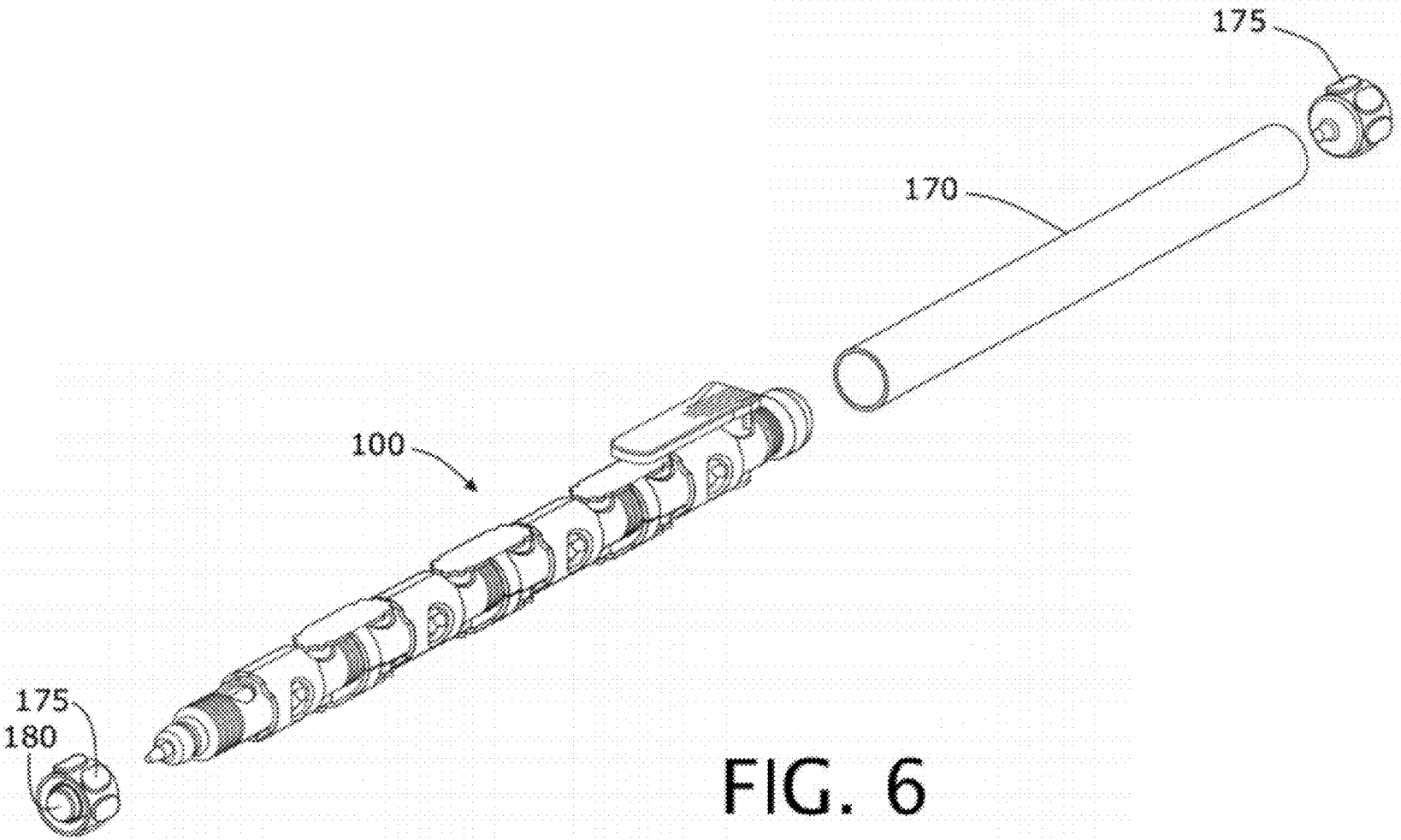
FIG. 6 is an illustration of a shipping tube with toy end-cap and 'wheel' elements that may be part of an assembled toy.

In one embodiment shown in FIG. 2, the proximal and distal pen bodies 160 and 162 can further include spring 166 and an actuation mechanisms as well known in the art to provide a push button retractable ball-point pen FIG. 6 depicts another embodiment in which a delivery tube component 170 is provided as packaging for an assembly of structural elements 110, 112, 114, 115, 160 and 162 that are either assembled as a pen or that can be assembled into a pen. In addition, the end-caps 175 of tube component 170 comprise toy structural elements as well, and more particularly are configured as toy 'wheels' with each having a connector portion such as projecting element 180 that can be snap-fit into a receiving connector feature 130 of another structural element. It should be appreciated end-cap 'wheels' 175 can have either or both 'projecting' and 'receiving' connector features as described above to allow coupling to complementary features at the side or end of any other structure elements, or the end-cap 'wheels' can couple about their axles one to another to provide tandem toy wheel elements. Further, the toy wheels can be rotatable about an axle portion or the element that comprises a projecting and/or receiving feature thereof that is capable of connection with a complementary feature of another structural element. Further, the delivery tube component 170 can be connected at its end to extend from a wheel 175 that is connected to another assembly, for example to provide an elongate element such as a rotating helicopter blade (not shown). Further, the delivery tube 170 can further include projecting and/or receiving features (not shown) along its side to allow its connection to a toy in a plurality of configurations.

Figure 7:
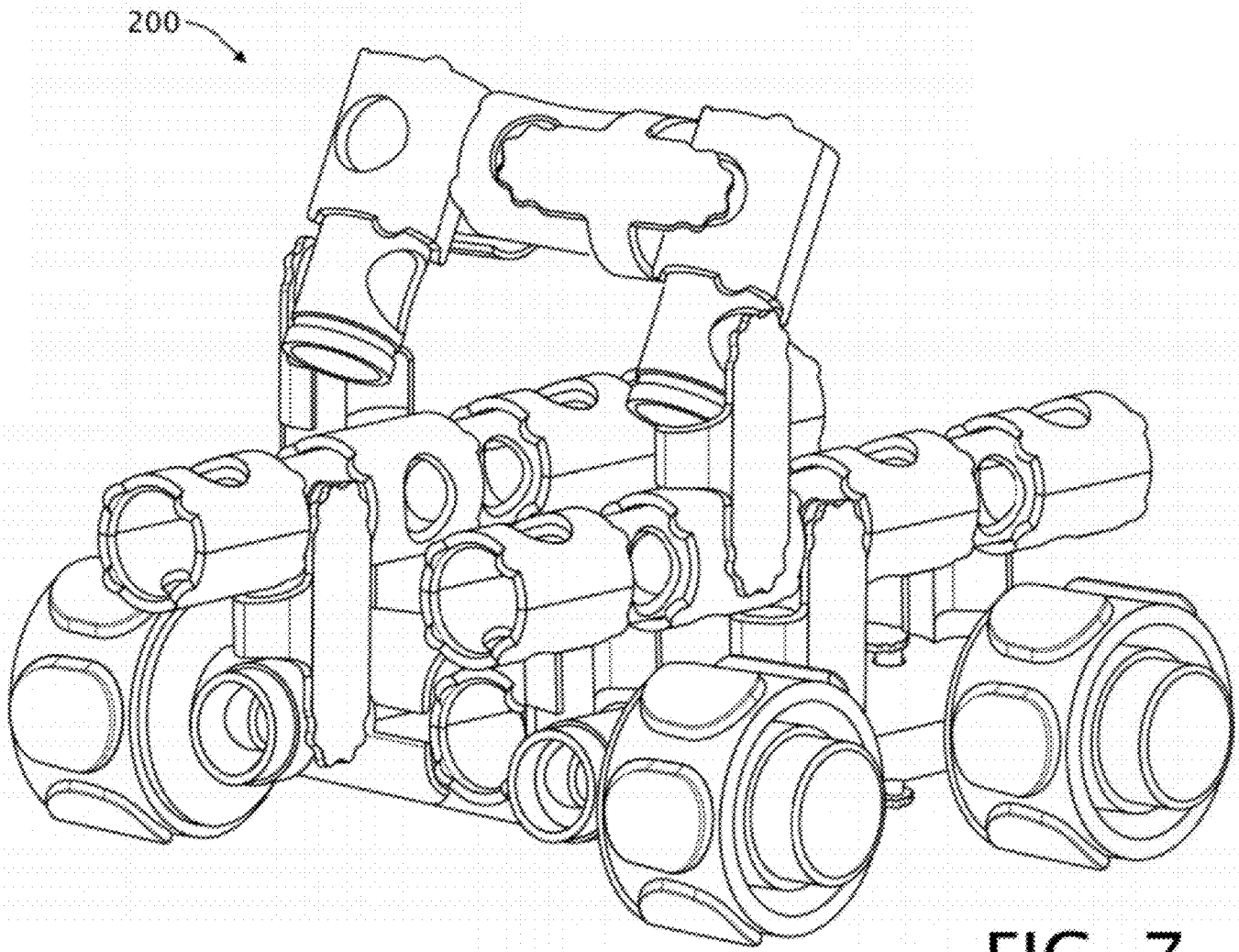
FIG. 7 is a perspective view of a toy vehicle assembled from a set of structural elements with connector features as in FIGS. 3-5.

Now turning to FIG. 7, one embodiment of a toy 'buggy' vehicle or landcraft 200 is shown that is assembled from exemplary structural elements 110, 112 and 114 as described above. In FIG. 7 and the exploded view of FIG. 8, it can be seen that a plurality of the structural elements can be assembled into a vehicle chassis assembly 205 with four wheel (end-cap) elements 175. Further, as can be seen in FIG. 8, the vehicle body assembly 210 and windscreen assembly 215 are provided by coupling together various arrangements of structural elements 110, 112 and 114.

Figure 8:
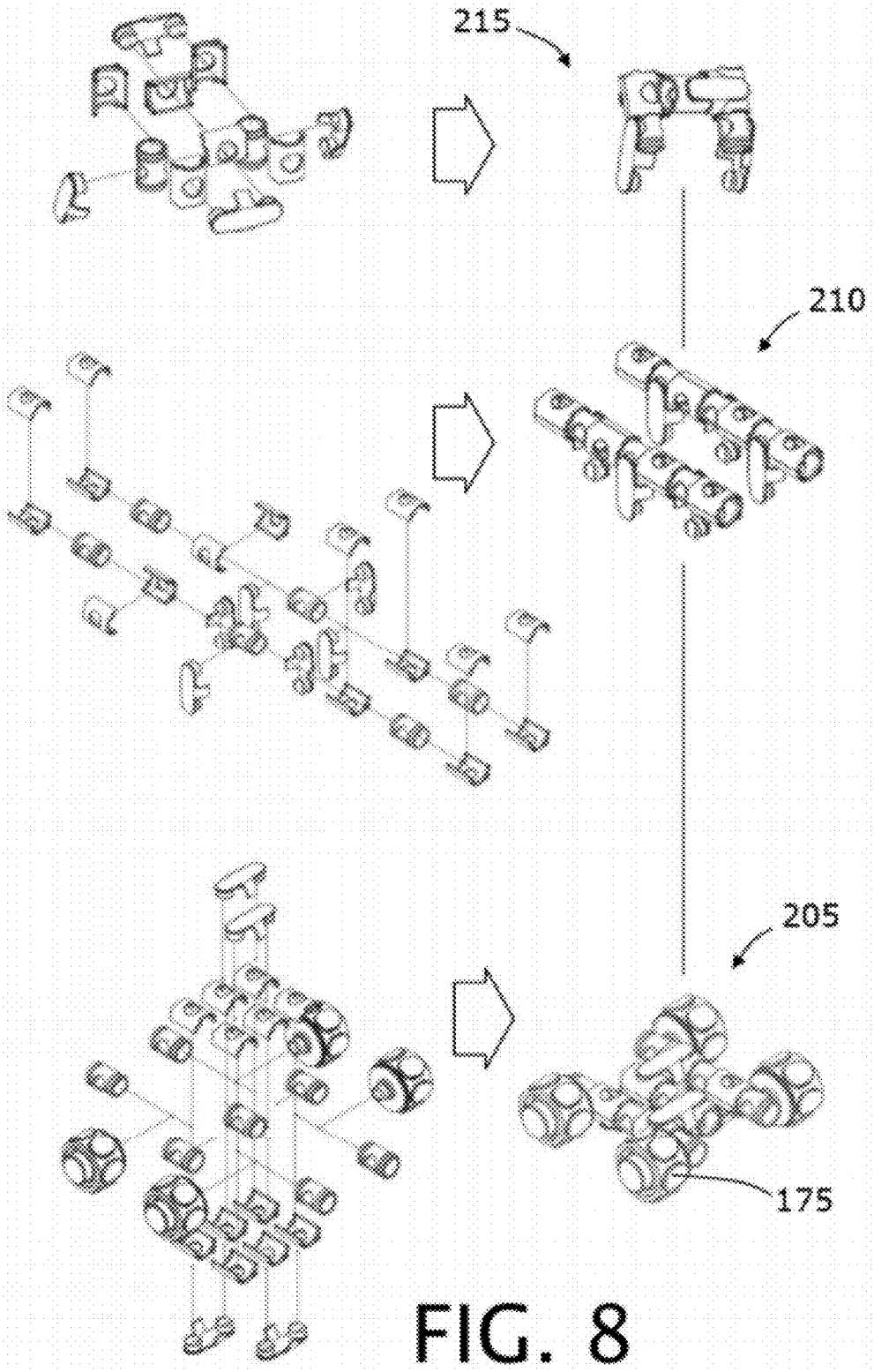
FIG. 8 is an exploded diagram view illustrating the details of assembling the structural elements into the toy vehicle of FIG. 7.

It can be appreciated that FIGS. 7 and 8 illustrate only one of a practically infinite number of toys that can be assembled from the structural elements of the invention. A plurality of such structural elements can be connected together to provide any desired three-dimensional geometric shape, such as resembling one or more portions of a spacecraft, aircraft, landcraft, watercraft, or submarine. Any assembled toy may be a static form or a non-static such as a land- or aircraft with rotating wheels or blades. The structural elements also can connected together to provide geometric shapes resembling buildings, constructions, castles, pyramids, geographic and topographic features, planetary arrangements and the like. The structural elements also can connected together to provide geometric shapes resembling torsos, legs, arms or heads of a human, an animal or fantasy being, free-form structures, stick-form molecules, geometric forms or even wearable ornaments.

Figure 9B:
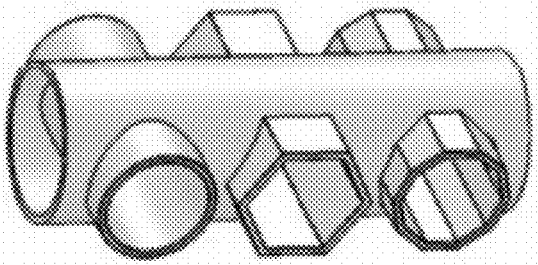
FIG. 9B is a view of mated receiving and projecting features of FIG. 9A.
Figure 9A:
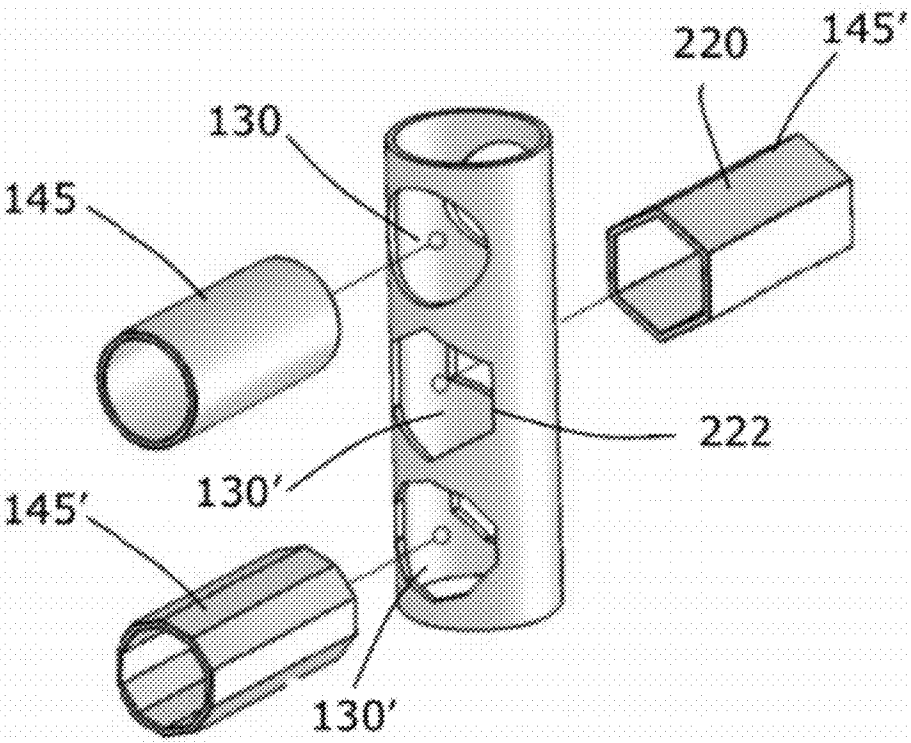
FIG. 9A is a perspective schematic view of de-mated complementary receiving and projecting features that include complementary facets for click-stop rotational orientation of structural elements about a connection.

As shown in FIGS. 2, 7, 8 and 9A, it can be seen that the cross-sections of complementary connection comprising 'receiving' features 130 and projecting features 145 are round thus allowing for freedom of rotation between the structural elements about the connection. In another embodiment, referring to FIGS. 9A and 9B, it can be seen that the cross-sections of complementary 'receiving' features 130' and snap-fit projecting features 145' can be non-round and provided with at least one set of complementary facets 220 and 222 for allowing a 'click-stop' rotational orientation of one structural element relative to another.

Figure 10B:
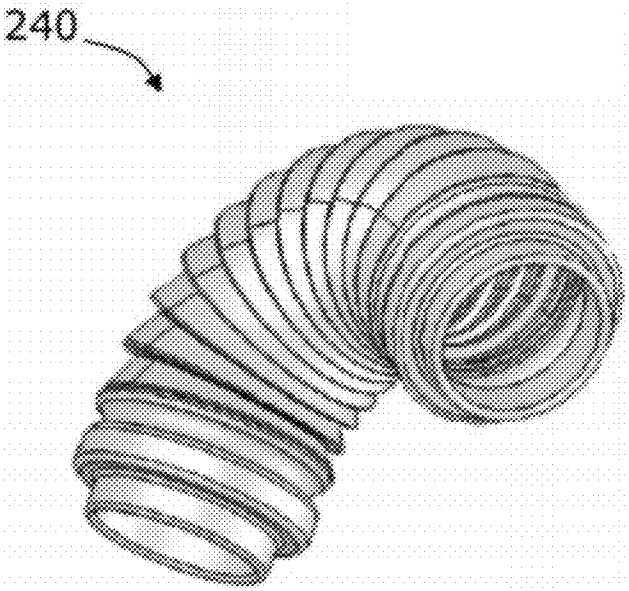
FIG. 10B is an illustration of the flexible structural element of FIG. 10A in a flexed position.
Figure 10A:
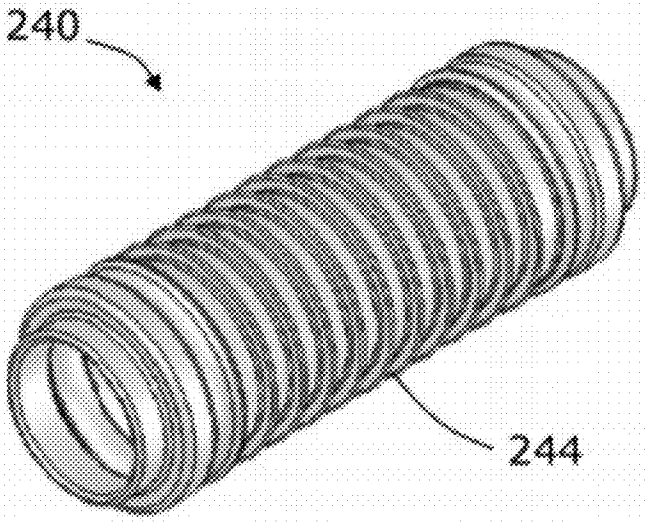
FIG. 10A is an illustration of another structural element in a repose position that includes a flexible medial portion.
Figure 10C:
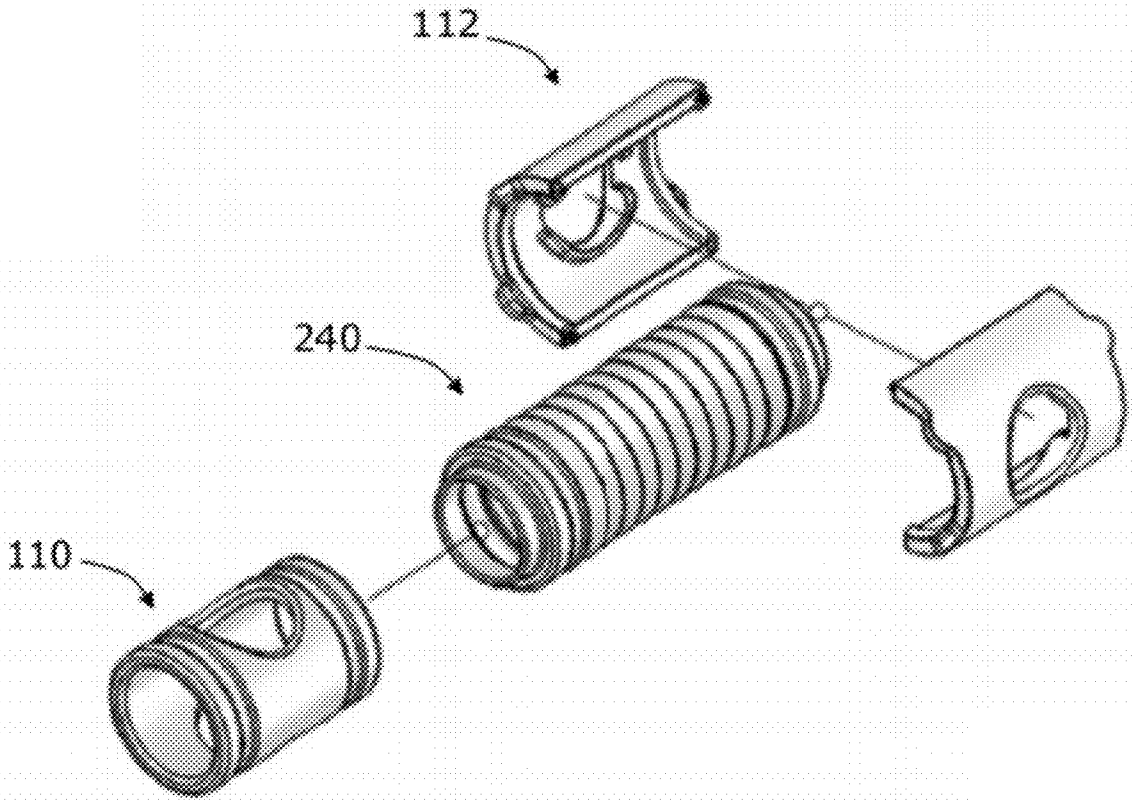
FIG. 10C is an illustration of a connection assembly that includes the flexible structural element of FIG. 10A.

Another embodiment of a structural element 240 is shown in FIGS. 10A and 10B, wherein a medial portion of the element comprised a flexible body portion 244. FIG. 10C illustrates that the ends of flexible element 240 are configured for snap fit into a receiving features of assembled elements 112. FIG. 10A illustrates a flexible plastic bellows, but it should be appreciated the flexible body portion 244 can comprise a rubber or foam material, a helical spring or the like.

Figure 11:
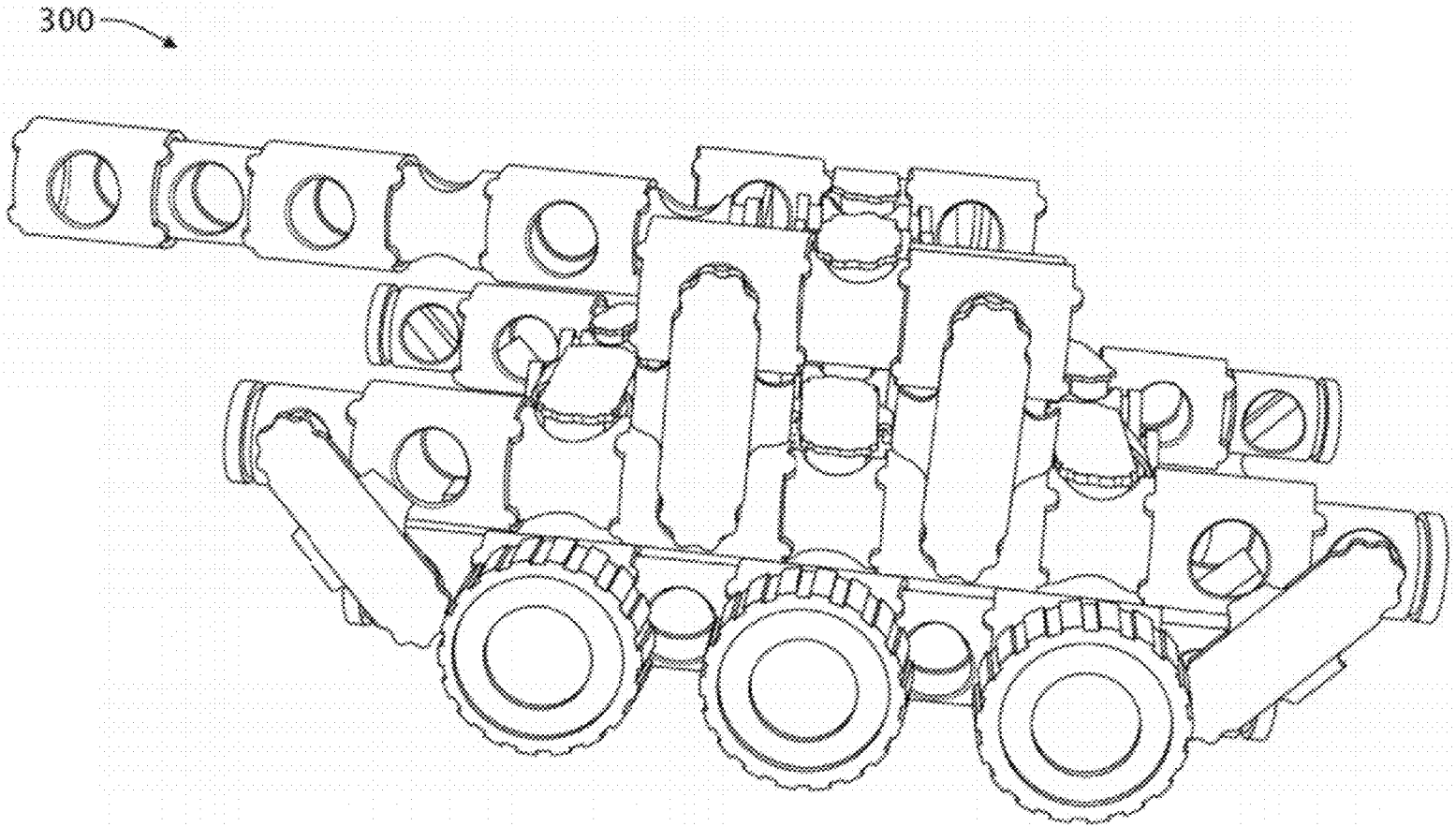
FIG. 11 is a perspective view of another toy in the shape of a tank assembled from a set of structural elements as in FIGS. 3-5.
Figure 12:
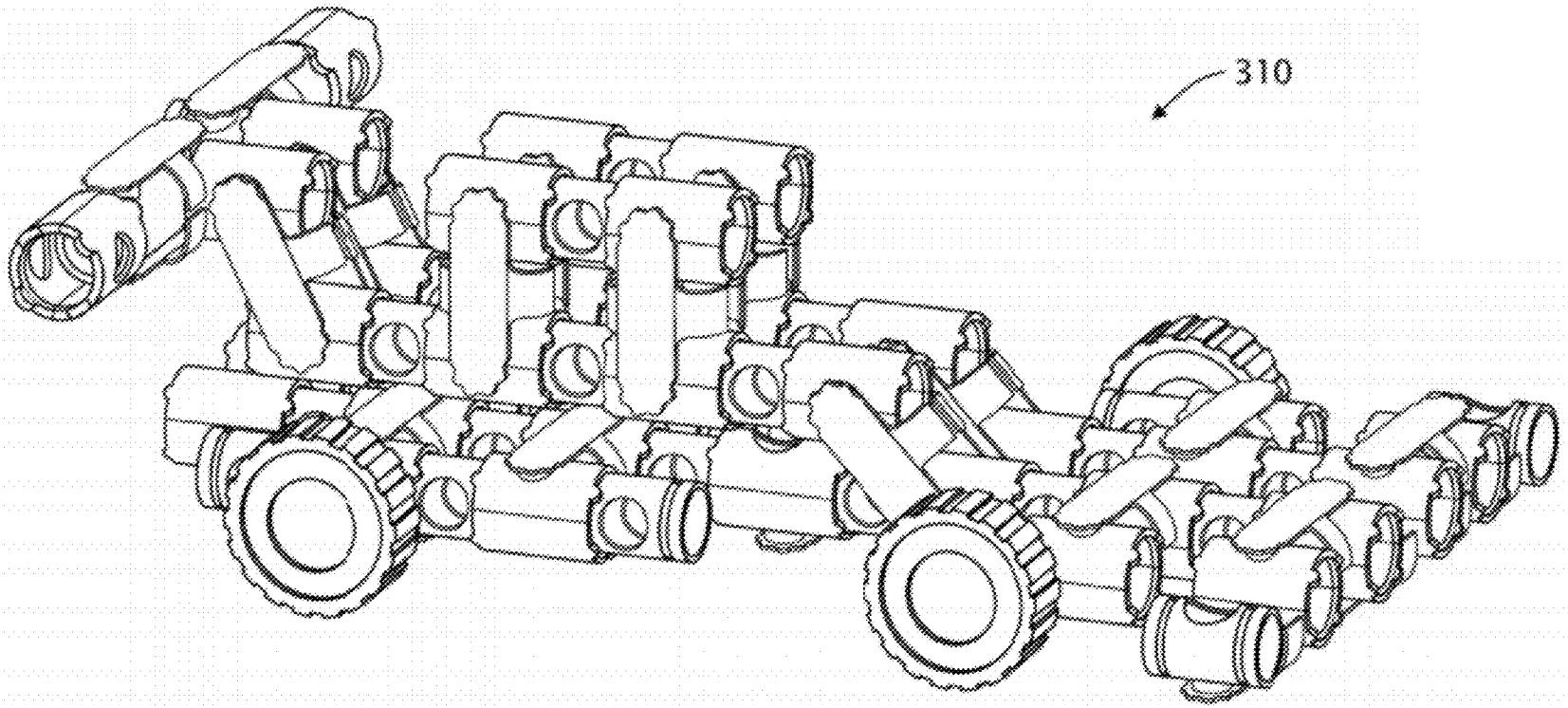
FIG. 12 is a perspective view of another toy in the shape of a vehicle assembled from a set of structural elements as in FIGS. 3-5.

FIG. 11 illustrates an assembly of structural elements 110, 112, 114 and 175 into a tank 300. FIG. 12 illustrates an assembly of structural elements 110, 112, 114 and 175 into another embodiment of a vehicle 310.

In another embodiment (not shown), the connector 'receiving' and projecting features can include complementary magnetic structures (preferably neodymium magnets) rather than snap-fit moldable plastic features. The structural elements that include flexible body portions enables the construction of toys with a truly infinite number of possible geometric shapes so there is no limit but the child's imagination as to what can be constructed using the inventive system.

The modular structural elements and system are adapted to foster creative expression, and to allow a child to created custom toys and playscapes. The structural elements are not limited to any particular size, elongate dimensions or shape. The structural elements are preferably made of a moldable plastic that is clear, colored or translucent, for example an ABS plastic. It should be appreciated that structural elements also can be any moldable foam, rubber or metal as is know in the art. In one embodiment as shown in FIG. 5, the surfaces of a structural element can include bumps or facets 250 for contacting a surface feature of another structural element to provide a particular orientation.

While the foregoing has been with reference to a particular embodiment of the invention, the foregoing description is that of certain features, aspects and advantages of the present invention, to which various changes and modifications can be made without departing from the spirit and scope of the present invention. Thus, for example, those skilled in the art will recognize that the invention can be embodied or carried out in a manner that achieves or optimizes one advantage or a group of advantages as taught herein without necessarily achieving other objects or advantages as may be taught or suggested herein. In addition, while a number of variations of the invention have been shown and described in detail, other modifications and methods of use, which are within the scope of this invention, will be readily apparent to those of skill in the art based upon this disclosure. It is contemplated that various combinations or subcombinations of these specific features and aspects of embodiments may be made and still fall within the scope of the invention. Accordingly, it should be understood that various features and aspects of the disclosed embodiments can be combined with or substituted for one another in order to form varying modes of the discussed bone treatment systems and methods.

What is claimed is:

1. A combination toy and writing accessory comprising:

a writing instrument;

a plurality of structural elements connectable to one another in a surrounding arrangement relative to the writing instrument;

where the plurality of structural elements comprise at least a plurality of first connector portions and a plurality of second connector portions, where all of the first connector portions have a first form and all of the second connector portions have a second form, such that the first form is different than the second form; and where the plurality of structural elements are detachable from the surrounding arrangement and each first connector portion can be releasable coupled at least one second connector portion, such that any number of the structural elements can be joined with or without the writing instrument a plurality of assembly arrangements to form a toy assembly.

2. The combination of claim 1 wherein the writing instrument is selected from the group consisting of pens, pencils, markers and crayons.

3. The combination of claim 1 wherein the structural elements are at least in part plastic, rubber, foam and metal.

4. The combination of claim 1 wherein the structural elements have a plurality of colors.

5. The combination of claim 1 wherein the structural elements have a substantially rigid medial portion.

6. The combination of claim 1 wherein the structural elements include a flexible medial portion.

7. The combination of claim 1 wherein the first and second connector portions comprise cooperating projecting structures and receiving structures.

8. The combination of claim 1 wherein the first and second connector portions comprise cooperating snap-fit structures.

9. The combination of claim 1 wherein at least one of the first and second connector portions has a round cross-section.

10. The combination of claim 1 wherein at least one of the first and second connector portions has a non-round cross-section.

11. The combination of claim 1 wherein a first connector portion includes facets for click-stop rotational orientation relative to a second connector portion.

12. The combination of claim 1 wherein the first and second connector portions include cooperating magnetic structures.

13. The combination of claim 1 wherein a plurality structural elements connected together have a predetermined three-dimensional geometric shape resembling one or more portions of a spacecraft, aircraft, landcraft, watercraft, submarine, building, torso, leg, arm, head, machine, weapon, ornament or free-form structure.

14. A combination writing device and novelty, comprising a plurality of snap-fit elements and a writing instrument, wherein the snap-fit elements are capable of snap-fit assembly in surrounding engagement of the writing instrument;

and where the plurality of snap-fit elements comprise at least a plurality of first connector portions and a plurality of second connector portions, where all of the first connector portions have a first form and all of the second connector portions have a second form, such that the first form is different than the second form; and where the plurality of snap-fit elements are detachable from the surrounding arrangement and each first connector portion can be releasable coupled at least one second connector portion, such that any number of the snap-fit elements can be joined with or without the writing instrument to form a new assembly.

15. The combination of claim 14 wherein the plurality of snap-fit elements are configured for a longitudinal snap-fit assembly.

16. The combination of claim 14 wherein the plurality of snap-fit elements are configured for a non-longitudinal snap-fit assembly.

17. The combination of claim 14 wherein the assembly comprises one or more portions of a spacecraft, aircraft, landcraft, watercraft, submarine, building, torso, leg, arm, head, machine, weapon, ornament or free-form structure.

18. The combination of claim 14 wherein the snap-fit elements includes facet features for click-stop rotational orientation between first and second engaged snap-fit elements.

19. The combination of claim 14 wherein the writing instrument is selected from the group consisting of pens, pencils, markers, crayons and erasers.

20. A combination writing device and toy, comprising:

a plurality of connectable elements that connect about cooperating projecting and receiving features;

where the plurality of connectable elements comprise at least a plurality of first connector portions and a plurality of second connector portions, where all of the first connector portions have a first form and all of the second connector portions have a second form, such that the first form is different than the second form, where each first connector portion can be releasable coupled at least one second connector portion, such that any number of the snap-fit elements can be joined with or without the writing instrument to form a new assembly;

wherein the connectable elements are connectable to house a writing instrument in an interior passageway; and an elongated tubular container capable of carrying a plurality of connectable elements and a writing cartridge therein, the container including at least one of a projecting or receiving feature for connecting to a connectable element.

21. The combination of claim 20 wherein the connectable elements have cooperating projecting and receiving features that include at least one of snap-fit features, friction fit features or magnetic features.

22. The combination of claim 20 wherein the tubular container includes a projecting or receiving features at an end thereof.

23. The combination of claim 20 wherein the tubular container includes a projecting or receiving features about a side thereof.

24. The combination of claim 20 further comprising container end-caps that are connectable to first and second ends of the tubular container.

25. The combination of claim 24 wherein the container end-caps have the form of a toy wheel.

26. The combination of claim 24 wherein the container end-caps in the form of a toy wheel have both projecting and receiving features.

27. The combination of claim 24 wherein the container end-caps in the form of a toy wheel are rotatable about a projecting or receiving feature.

* * * * *